US006046532A

United States Patent [19]

Matsutani et al.

[11] Patent Number: 6,046,532

[45] Date of Patent: Apr. 4, 2000

[54] SPARK PLUG

[75] Inventors: Wataru Matsutani, Nagoya; Ichiro Gonda, Konan, both of Japan

[73] Assignee: NGK Spark Plug Co., Ltd., Japan

[21] Appl. No.: 09/191,967

[22] Filed: Nov. 13, 1998

[30] Foreign Application Priority Data

Nov. 19, 1997 [JP] Japan ..... 9-336470

[51] Int. Cl.[7] ..... H01T 13/20

[52] U.S. Cl. ..... 313/141; 313/142

[58] Field of Search ..... 313/141, 142; 123/169 EL

[56] References Cited

U.S. PATENT DOCUMENTS

| | | | |
|---|---|---|---|
| 5,017,826 | 5/1991 | Oshima et al. | 313/141 |
| 5,461,275 | 10/1995 | Oshima | 313/141 |
| 5,488,262 | 1/1996 | Takamura | 313/141 |

FOREIGN PATENT DOCUMENTS

| | | |
|---|---|---|
| 0 635 920 B1 | 11/1996 | European Pat. Off. . |
| 57-40880 | 5/1982 | Japan . |
| 3-176978 | 7/1991 | Japan . |
| 7-37677 | 2/1995 | Japan . |
| 9-7733 | 1/1997 | Japan . |
| 2302367 | 1/1997 | United Kingdom . |

*Primary Examiner*—NimeshKumar D. Patel
*Assistant Examiner*—Todd Reed Hopper
*Attorney, Agent, or Firm*—Brinks Hofer Gilson & Lione

[57] ABSTRACT

A spark plug includes a center electrode, an insulator provided outside the center electrode, a metallic shell provided outside the insulator, a ground electrode disposed to oppose the center electrode, and a spark discharge portion fixed on at least one of the center electrode and the ground electrode for defining a spark discharge gap. The spark discharge portion of the spark plug is formed of a metallic material containing Ir as a main component, and a region where the Vickers hardness is not greater than Hv 400 extends from the surface of the spark discharge portion to a depth of 0.05 mm or more. The average value of $d_{min}/d_{max}$ ratios of grains on an arbitrary cross-section is preferably equal to or greater than 0.7 where $d_{min}$ represents the minimum diameter of each grain on the cross-section and $d_{max}$ represents the maximum diameter of the grain. The ratio of hS/hB is preferably not greater than 0.9, where hS represents an average Vickers hardness measured in a surface layer region extending to a depth of 0.05 mm from the surface that faces the spark discharge gap, and hB represents an average Vickers hardness measured in the remaining region. The spark discharge portion is formed of a chip that is formed from a metallic material that contains Ir as a main component and is annealed at a temperature of 900° to 1700° C.

20 Claims, 8 Drawing Sheets

SPARK PLUG

BACKGROUND OF THE INVENTION

1. Field of the Invention

The present invention relates to a spark plug used in an internal combustion engine.

2. Description of the Related Art

Conventionally, a spark plug for an internal combustion engine such as an automobile engine employs a Pt (platinum) alloy chip welded to an end of an electrode for use as a spark discharge portion having improved spark consumption resistance. However, due to high cost and a relatively low melting point of 1769° C., platinum is not satisfactory as a spark-consumption-resistant material for spark plug use. Thus, there has been proposed use of Ir (iridium), which is inexpensive and has a higher melting point of 2454° C., as a material for a chip.

However, since Ir tends to produce a volatile oxide and be consumed at a high temperature zone ranging from 900° C. to 1000° C., a spark discharge portion formed from Ir involves a problem of consumption stemming from oxidation/volatilization rather than spark consumption. Accordingly, an Ir chip shows good endurance under low temperature conditions as in city driving, but has a problem of a significant reduction in endurance in highway driving. Thus, an attempt has been made to suppress consumption of a chip stemming from oxidation/volatilization of Ir, by adding an appropriate element to an alloy used as a material for a chip. For example, Japanese Patent Application Laid-Open (kokai) No. 9-7733 discloses a spark plug whose chip is improved in high-temperature heat resistance and consumption resistance by suppression of oxidation/volatilization of Ir through addition of Rh (rhodium). Also, in order to suppress oxidation/volatilization of Ir, there has been proposed use as a constituent material of a spark discharge portion, a material obtained through dispersion of a rare-earth oxide such as $Y_2O_3$ into Ir (see Japanese Patent Application Laid-Open (kokai) No. 7-37677). However, in recent years, the temperature range in which spark plugs are used has become higher with a recent increase in engine output, and therefore, a spark plug having more excellent durability is demanded.

SUMMARY OF THE INVENTION

An object of the present invention is to provide a spark plug whose spark discharge portion is formed from a metallic material containing Ir as a main component, but which shows less susceptibility to consumption stemming from oxidation/volatilization of Ir at high temperature, to thereby secure excellent durability.

To achieve the above-described object, the present invention provides a spark plug that includes a center electrode, an insulator provided outside the center electrode, a metallic shell provided outside the insulator, a ground electrode disposed to oppose the center electrode, and a spark discharge portion fixed on at least one of the center electrode and the ground electrode for defining a spark discharge gap. According to a first aspect of the present invention, the spark discharge portion of the spark plug is formed of a metallic material containing Ir as a main component, and a region where the Vickers hardness is not greater than Hv 400 extends from the surface of the spark discharge portion to a depth of 0.05 mm or more.

According to a second aspect of the present invention, the spark discharge portion of the spark plug is formed of a metallic material containing Ir as a main component, and the average value of $d_{min}/d_{max}$ ratios of grains on an arbitrary cross-section is equal to or greater than 0.7 where $d_{min}$ represents the minimum diameter of each grain on the cross-section and $d_{max}$ represents the maximum diameter of the grain.

According to a third aspect of the present invention, the spark discharge portion of the spark plug is formed of a metallic material containing Ir as a main component, and the ratio of hS/hB is not greater than 0.9, where hS represents an average Vickers hardness measured in a surface layer region extending to a depth of 0.05 mm from the surface that faces the spark discharge gap, and hB represents an average Vickers hardness measured in the remaining region. Preferably, the spark discharge portion is formed of a chip that is formed from a metallic material that contains Ir as a main component and is annealed at a temperature of 900° to 1700° C.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DETAILED DESCRIPTION OF THE INVENTION AND EMBODIMENTS

Figure 1:
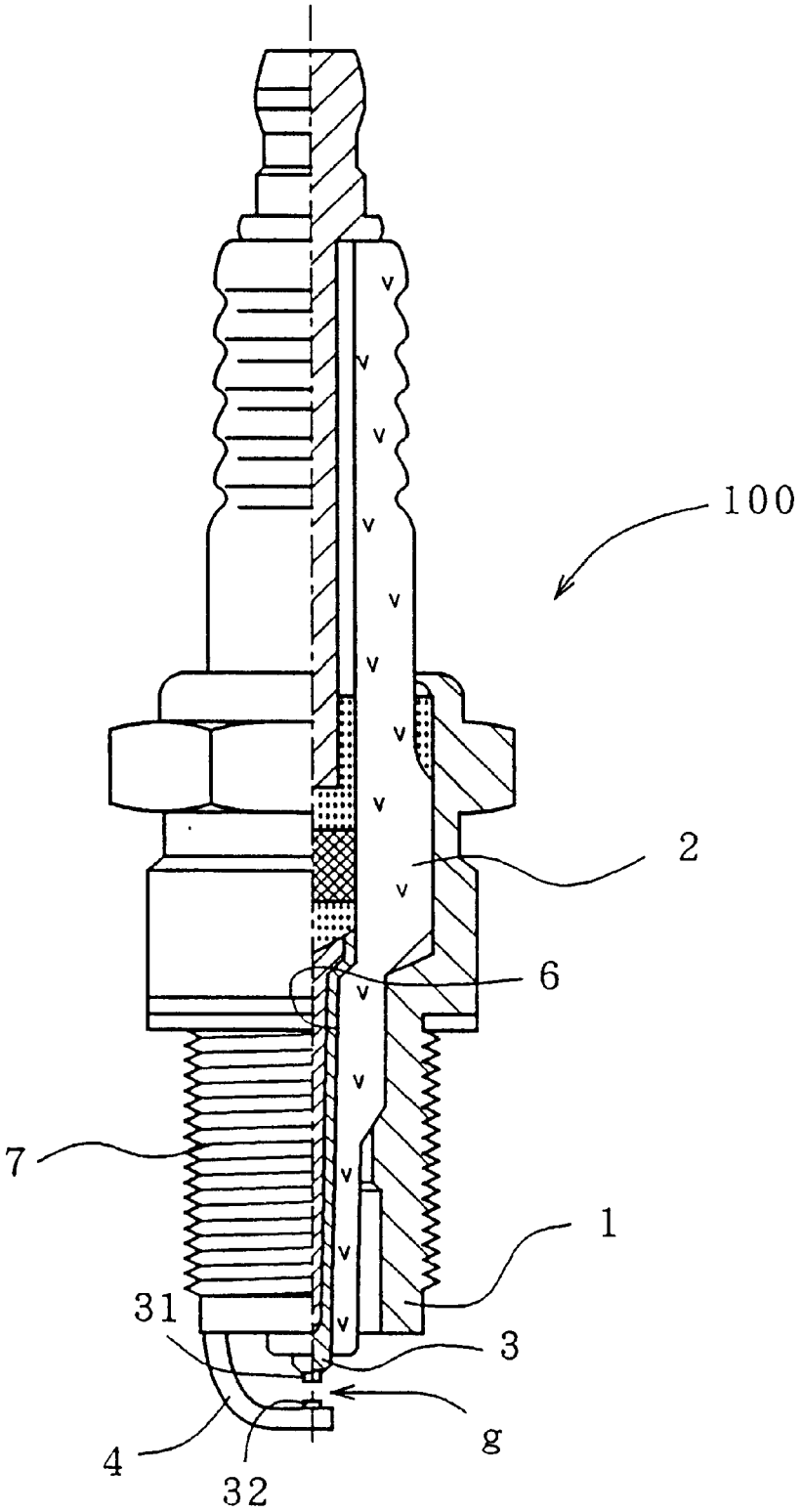
FIG. 1 is a semi-cross-sectional view of a spark plug according to the present invention.

The present disclosure relates to subject matter contained in Japanese Patent Application No. HEI 9-336470, filed on Nov. 19, 1997, which is expressly incorporated herein by reference in its entirety.

The present inventors have found that in the case where a spark discharge portion—which forms a spark discharge gap—is formed from a metallic material containing Ir as a main component, there is effectively suppressed consumption of the spark discharge portion stemming from oxidation/volatilization of the Ir component at high temperatures, if the Vickers hardness of the spark discharge portion is made not greater than Hv 400 in a surface layer region extending from the surface of the spark discharge portion to a depth of 0.05 mm or more.

In the spark discharge portion of the spark plug, when the thickness or depth of the surface layer region where the Vickers hardness is not greater than Hv 400 is less than 0.05 mm, the effect of suppressing consumption of the spark discharge portion stemming from oxidation/volatilization of the Ir component at high temperatures is not obtained to a sufficient degree. The Vickers hardness in the surface layer region is preferably not greater than Hv 370. The thickness or depth of the surface layer region where the Vickers hardness is not greater than Hv 400 (preferably not greater than Hv 370) is preferably 0.1 mm or more.

The spark discharge portion may be formed through welding of a chip formed from a metallic material containing Ir as a main component to a ground electrode and/or a center electrode. In this specification, the "spark discharge portion" denotes a portion of a welded chip that is free from variations in composition caused by welding (i.e. other than the portion of the welded chip which has alloyed with a material of the ground electrode or center electrode due to welding).

In this case, the spark discharge portion may be formed as follows. A metallic material containing Ir as a main component is subjected to a predetermined machining process to obtain a chip, which is then annealed at a temperature of 900° to 1700° C. The annealed chip is fixed to at least one of the ground electrode and the center electrode. In this specification, the term "machining process" means rolling, forging, punching, or a combination of these processes. In this case, rolling, forging, cutting, punching, or a like process may be performed in the form of so-called hot working (or warm working) in which alloy is subjected to a machining process after being heated to a predetermined temperature. Although the temperature during machining changes depending on the composition of the alloy, a preferable result can be obtained when the temperature is set to 700° C. or higher. A more specific example of the method of manufacturing chips is as follows. A molten alloy is formed into a plate material through hot rolling, and the plate material is subjected to hot punching to punch out chips having a predetermined shape. Alternatively, a molten alloy is formed into a wire or rod through hot rolling or hot forging, and the wire or rod is cut to a predetermined length to form chips.

In a chip manufactured through the above-described steps, a considerable amount of distortion remains due to plastic working, resulting in work hardening. Especially, in a surface layer region where the degree of residual distortion is large, the hardness has increased considerably. The studies performed earnestly by the inventors of the present invention revealed that if such a chip is fixed as is to the ground electrode or the center electrode of a spark plug, in order to form a spark discharge portion, the spark discharge portion comes to be easily consumed due to oxidation/volatilization of the Ir component, resulting in deterioration of the durability of the spark plug. The present inventors found that when a chip is annealed at a temperature of 900° to 1700° C. in order to soften the chip such that the thickness or depth of the surface layer region where the Vickers hardness is not greater than Hv 400 (preferably not greater than Hv 370) becomes 0.05 mm or greater (preferably 0.1 mm or greater), oxidation/volatilization of the Ir component is effectively suppressed, so that the durability of the spark plug is increased. The present invention was accomplished based on this finding. In order to suppress oxidation/volatilization of Ir during processing, the annealing is preferably performed in an inert gas atmosphere, a vacuum atmosphere at $10^{-3}$ torr or less, or a reduction atmosphere such as a hydrogen atmosphere.

When the annealing temperature is lower than 900° C., the chip is not softened sufficiently, resulting in a failure to obtain a sufficient effect of suppressing oxidation/volatilization of the Ir component of the spark discharge portion. When the annealing temperature exceeds 1700° C., the chip is softened excessively, resulting in deformation of the chip, and volatilization of the Ir component proceeds quickly. Therefore, annealing temperatures higher than 1700° C. are not preferred. The annealing temperature is preferably adjusted within a range of 1000° to 1500° C.

Figure 6:
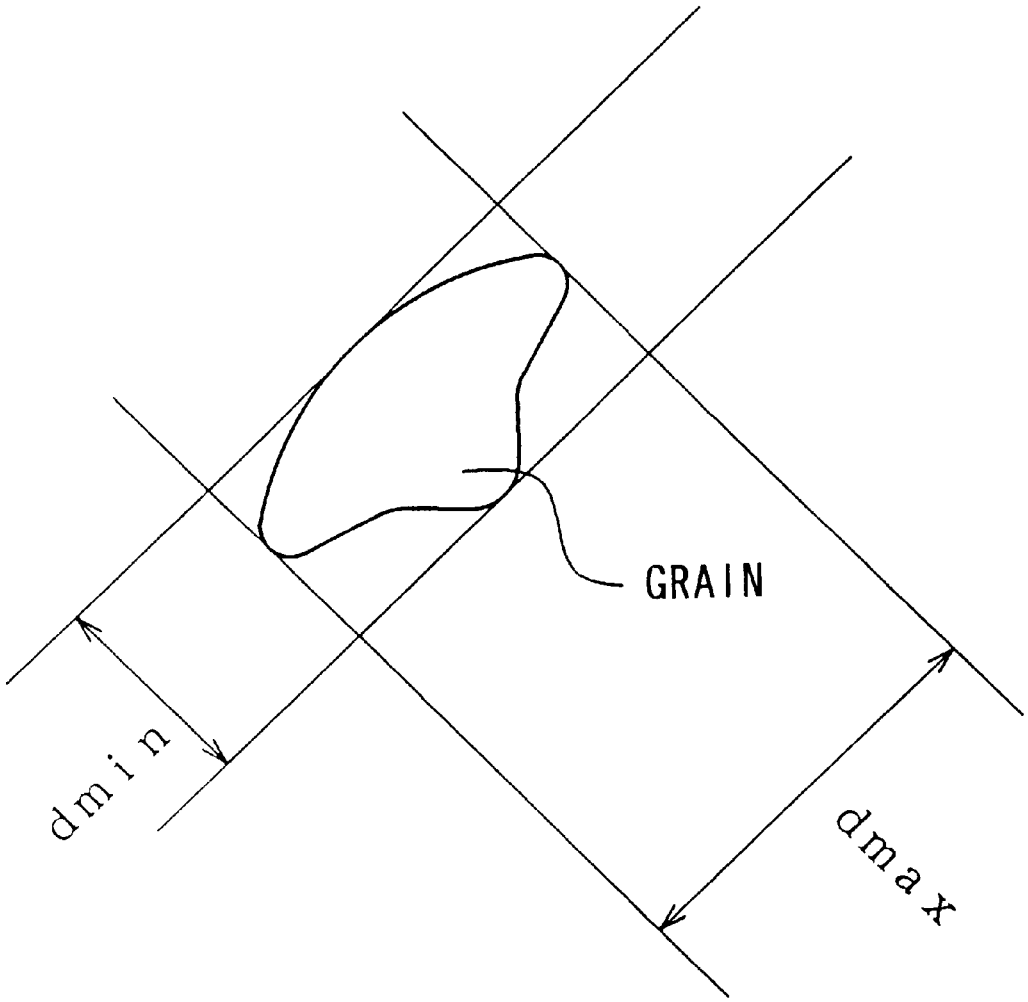
FIG. 6 is an explanatory view showing the definition of the maximum and minimum diameters of grains within the chip.

As shown in FIG. 6, when a spark discharge portion is cross-sectioned, grains appear on the cross section. For each grain, two parallel lines are drawn such that they come into contact with the outline of the grain but do not pass through the interior of the grain. Such parallel lines are drawn repeatedly while the relationship between the parallel lines and the grain is changed. The largest distance between the lines is measured as the maximum diameter $d_{max}$ of the grain, while the shortest distance between the lines is measured as the minimum diameter $d_{min}$ of the grain. On an arbitrary cross-section, the ratio of $d_{min}/d_{max}$ is calculated for each grain, and the average value of the $d_{min}/d_{max}$ ratios of the grains is calculated. When the thus-calculated average value is not less than 0.7, oxidation/ volatilization of the Ir component of the spark discharge portion is suppressed more effectively. That is, as described above, the material of a chip that has undergone severe processing such as rolling and wire drawing has undergone work hardening, which is not preferably in terms of suppression of oxidation/ volatilization of the Ir component of the spark discharge portion. When the material of the chip undergoes severe processing, grains (mainly crystalline grains) are stretched in the direction of the work, so that the $d_{min}/d_{max}$ ratio of each grain becomes small. However, when the above-described annealing causes recrystallization, so that the $d_{min}/d_{max}$ ratio gradually increases. When the average value of the $d_{min}/d_{max}$ ratio becomes 0.7 or greater, oxidation/ volatilization of the Ir component of the spark discharge portion is suppressed more effectively, so that the service life of the spark plug can be increased. The average value of the $d_{min}/d_{max}$ ratio is preferably 0.75 or greater.

When the degree of work hardening of a chip for forming a spark discharge portion is considerably large, the center portion of the chip is not softened very much in some cases, e.g., if restoration and recrystallization of grains are restricted by surrounding crystal grains. In such a case, if the surface area region of the spark discharge portion formed through fixation of a chip is softened to a greater degree compared to the remaining area (i.e., the central region) such that the ratio of hS/hB becomes 0.9 or less (where hS represents an average Vickers hardness measured in a surface layer region extending to a depth of 0.05 mm from the surface that faces a spark discharge gap, and hB represents an average Vickers hardness measured in the remaining region), there can be expected some degree of effect in suppressing oxidation/volatilization of the Ir component of the spark discharge portion in order to increase the service life of the spark plug. The ratio of hS/hB is preferably set to 0.85 or less.

The above-described spark discharge portion may be formed of one of the following alloys, each of which contains Ir as a main component.

(1) An alloy that contains Ir (a main component) and Rh (at least 3 wt. % but less than 50 wt. %). Use of this alloy effectively suppresses consumption of the spark discharge portion stemming from oxidation/volatilization of the Ir component at high temperature, so that a spark plug having excellent durability is realized.

When the Rh content of the alloy is less than 3 wt. %, the effect of suppressing oxidation/volatilization of Ir becomes insufficient, so that the spark discharge portion comes to be easily consumed, resulting in deterioration in the durability of the spark plug. When the Rh content of the alloy is 50 wt. % or higher, the melting point of the alloy decreases, resulting in deterioration in the durability of the spark plug. In view of the above, the Rh content is adjusted within the above-described range, preferably within a range of 7 to 30 wt. %, more preferably within a range of 15 to 25 wt. %, most preferably within a range of 18 to 22 wt. %.

(2) An alloy that contains Ir (a main component) and Pt (1 to 20 wt. %). Use of this alloy effectively suppresses consumption of the spark discharge portion stemming from oxidation/volatilization of the Ir component at high temperature, so that a spark plug having excellent durability is realized. When the Pt content of the alloy is less than 1 wt. %, the effect of suppressing oxidation/volatilization of Ir becomes insufficient, so that the spark discharge portion comes to be easily consumed, resulting in deterioration in the durability of the spark plug. When the Pt content of the alloy is 20 wt. % or higher, the melting point of the alloy decreases, resulting in deterioration in the durability of the spark plug.

(3) An alloy that contains Ir (a main component), Rh (0.1 wt. % to 30 wt. %), and Ru (0.1 to 17 wt. %). Use of this alloy effectively suppresses consumption of the spark discharge portion stemming from oxidation/volatilization of the Ir component at high temperature, so that a spark plug having excellent durability is realized. When the Rh content of the alloy is less than 0.1 wt. %, the effect of suppressing oxidation/volatilization of Ir becomes insufficient, so that the spark discharge portion comes to be easily consumed, resulting in deterioration in the durability of the spark plug. When the Rh content of the alloy exceeds 30 wt. %, the melting point of the alloy decreases, resulting in failure to secure a required consumption resistance of the spark plug. Thus, the spark plug cannot have required durability. Therefore, the Rh content is adjusted within the above-described range.

When the Ru content is less than 0.1 wt. %, the effect of Ru addition in suppressing oxidation/volatilization of Ir becomes insufficient. When the Ru content exceeds 17 wt. %, consumption of the spark discharge portion proceeds to a greater extent as compared with the case where Ru is not added, resulting in failure to secure sufficient durability of the spark plug. Therefore, the Ru content is adjusted within the above-described range, preferably within a range of 0.1 to 13 wt. %, more preferably within a range of 0.5 to 10 wt. %.

The reason why the consumption resistance of the spark discharge portion is improved through incorporation of Ru into the alloy is assumed to be as follows. Through addition of Ru, a dense oxide film that is stable at high temperature is formed on the surface of the alloy, so that Ir—which is highly volatile when an oxide is formed from Ir only—is fixed within the oxide film. This oxide film conceivably functions as a passive-state film, to thereby suppress progress of oxidation of the Ir component. In a state where no Rh is added to the alloy, the resistance of the alloy to oxidation/volatilization at high temperature is not improved very much even if Ru is added to the alloy. Therefore, it is considered that the above-described oxide film is a composite oxide film of e.g., an Ir—Ru—Rh system, which is superior to an Ir—Ru system oxide film in terms of density and the degree of closeness of contact to the alloy surface.

When the Ru content increases excessively, consumption of the spark discharge portion due to sparking proceeds more quickly than does evaporation of Ir oxide, due to the following mechanism. That is, when the Ru content increases excessively, the denseness of the oxide film or the degree of closeness of contact to the alloy surface decreases, and this adverse effect becomes remarkable when the Ru content exceeds 17 wt. %. When impact of spark discharge of the spark plug repeatedly acts on the oxide film, the oxide film becomes likely to peel off, and a fresh metal surface is exposed, so that consumption of the spark discharge portion due to sparking proceeds quickly.

Further, the Ru addition achieves the following important effect. That is, when Ru is added into the alloy, even when the Rh content is reduced, a higher degree of consumption resistance can be secured as compared with the case where an Ir—Rh two-component system alloy is used. Thus, low cost production of high performance plugs is enabled. The Rh content is preferably set within a range of 0.1 to 3 wt. %, more preferably 0.1 to 1 wt. %.

The alloys (1), (2) and (3) described above may contain an oxide (including a composite oxide) of a metallic element of group 3A -,so-called rare earth elements) or 4A (Ti, Zr, and Hf) of the periodic table in an amount of 0.1 wt. % to 15 wt. %. The addition of such an oxide more effectively suppresses consumption of Ir stemming from oxidation/volatilization of Ir. When the oxide content is less than 0.1 wt. %, the effect of adding the oxide against oxidation/volatilization of Ir is not sufficiently achieved. By contrast, when the oxide content is in excess of 15 wt. %, the thermal shock resistance of a chip is impaired; consequently, the chip may crack, for example, when the chip is fixed to an electrode through welding or the like. Preferred examples of the oxide include $Y_2O_3$ as well as $LaO_3$, $ThO_2$, and $ZrO_2$.

Next, embodiments of the present invention will now be described with reference to the drawings.

Figure 2:
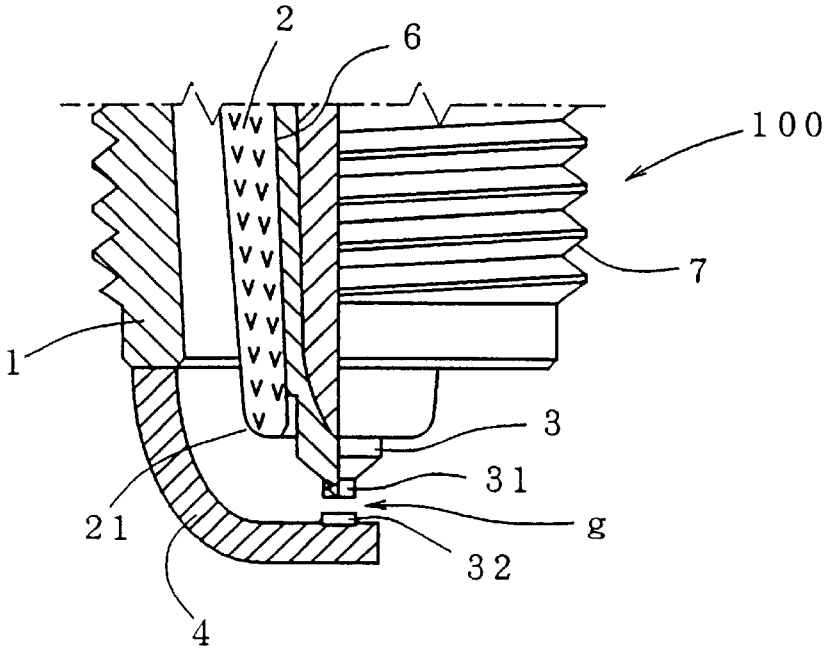
FIG. 2 is a partial cross-sectional view of the spark plug of FIG. 1.

As shown in FIGS. 1 and 2, a spark plug 100 includes a cylindrical metallic shell 1, an insulator 2, a center electrode 3, and a ground electrode 4. The insulator 2 is inserted into the metallic shell 1 such that a tip portion 21 of the insulator 2 projects from the metallic shell 1. The center electrode 3 is fittingly provided in the insulator 2 such that a spark discharge portion 31 formed at a tip of the center electrode 3 is projected from the insulator 2. One end of the ground electrode 4 is connected to the metallic shell 1 by welding or a like method, while the other end of the ground electrode 4 is bent sideward, facing the tip of the center electrode 3. A spark discharge portion 32 is formed on the ground electrode 4 so as to oppose the spark discharge portion 31. The spark discharge portions 31 and 32 define a spark discharge gap g therebetween.

The insulator 2 is formed from a sintered body of ceramics such as alumina ceramics or aluminum-nitride ceramics and has an axial, hollow portion 6 formed therein for receiving the center electrode 3. The metallic shell 1 is tubularly formed from metal such as low carbon steel and has threads 7 formed on the outer circumferential surface that are used for mounting the spark plug 100 to an engine block (not shown).

Body portions 3*a* and 4*a* of the center electrode 3 and ground electrode 4, respectively, are formed from a Ni alloy or like metal. The opposingly disposed spark discharge portions 31 and 32 are formed from an alloy containing Ir as a main component, such as Ir—Rh alloy.

Figure 3:
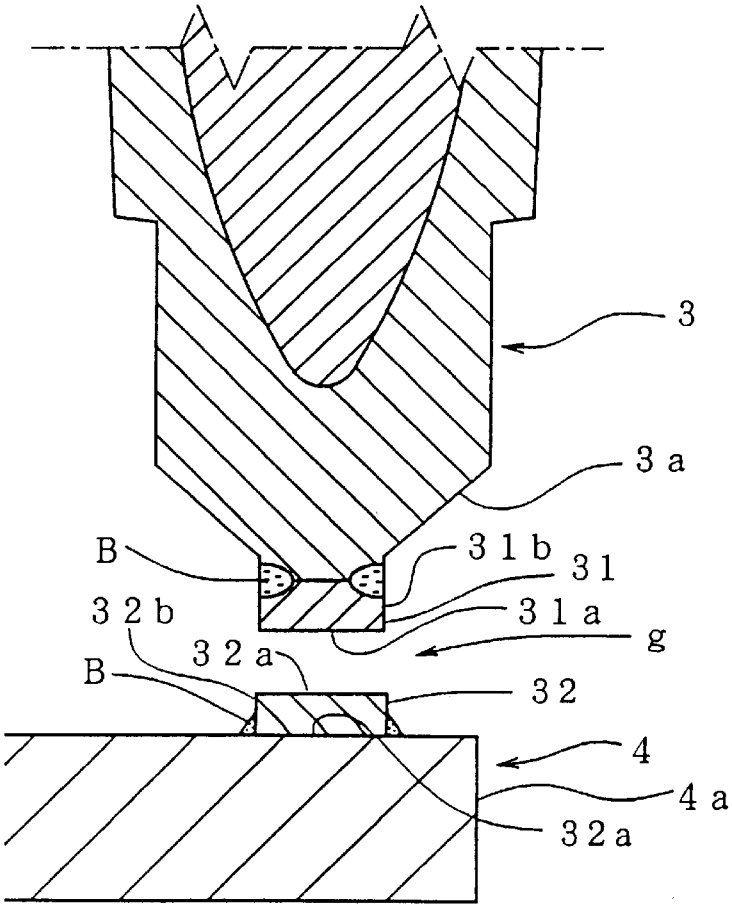
FIG. 3 is an enlarged cross-sectional view of essential portions of the spark plug of FIG. 1.

As shown in FIG. 3, the tip portion of the body 3*a* of the center electrode 3 is reduced in diameter toward the tip of the tip portion and has a flat tip face. A disk-shaped chip formed from the alloy described above and serving as material for the spark discharge portion 31 is placed on the flat tip face. Subsequently, a weld zone B is formed along the outer circumference of the boundary between the chip and the tip portion by laser welding, electron beam welding, resistance welding, or a like welding method, thereby fixedly attaching the chip onto the tip portion and forming the spark discharge portion 31. Likewise, a chip is placed on the ground electrode 4 in a position corresponding to the spark discharge portion 31; thereafter, a weld zone B is formed along the outer circumference of the boundary between the chip and the ground electrode 4, thereby fixedly attaching the chip onto the ground electrode 4 and forming the spark discharge portion 32. Either the spark discharge portion 31 or the spark discharge portion 32 may be omitted. In such a case, the spark discharge gap g is formed between the spark discharge portion 31 and the ground electrode 4 or between the center electrode 3 and the spark discharge portion 32.

The chips are manufactured as follows. A plurality of alloy components are mixed and melted in order to obtain a molten alloy having a predetermined composition. The thus-obtained molten alloy is formed into a plate material through, e.g., hot rolling, and the plate material is subjected to hot punching to punch out chips having a predetermined shape. The chips are then annealed at a temperature of 900° to 1700° C. (preferably, 1000° to 1500° C.) in a vacuum atmosphere, an inert gas atmosphere, or a reduction atmosphere such as a hydrogen atmosphere. Alternatively, a molten alloy is formed into a wire or rod through hot rolling or hot forging, and the wire or rod is cut to predetermined lengths to form chips, which are then subjected to annealing.

In each of the spark discharge portion 31 and the spark discharge portion 32 formed through fixture of the chips, a surface layer region where the Vickers hardness is not greater than Hv 400 (preferably not greater than Hv 370) extends from the surface to a depth of 0.05 mm or greater (preferably 0.1 mm or greater). Further, the spark discharge portion 31 and the spark discharge portion 32 are formed such that on an arbitrary cross-section, the average value of $d_{min}/d_{max}$ becomes 0.7 or greater (preferably, 0.75 or greater), wherein $d_{min}/d_{max}$ is the ratio of the minimum diameter $d_{min}$ to the maximum diameter $d_{min}$ determined for each grain (see FIG. 6).

Next, the action of the spark plug 100 will be described. The spark plug 100 is mounted to an engine block by means of the threads 7 and is used as an igniter for a mixture fed into a combustion chamber. Since the spark discharge portions 31 and 32, which are opposed to each other to form the spark discharge gap g therebetween, are formed from the aforementioned alloy, the consumption of the spark discharge portions 31 and 32 stemming from oxidation/volatilization of Ir is suppressed. Accordingly, the spark discharge gap g does not increase over a long period of use, thereby extending the service life of the spark plug 100.

Figure 5A:
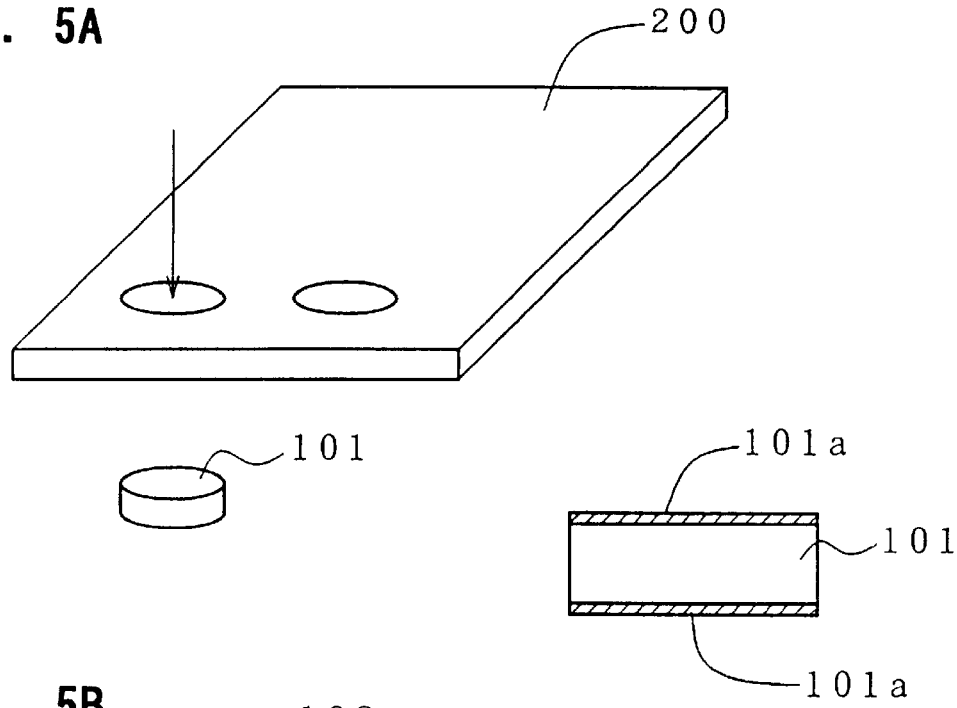
FIGS. 5A, 5B and 5C are explanatory views showing a method of manufacturing a tip.
Figure 5B:
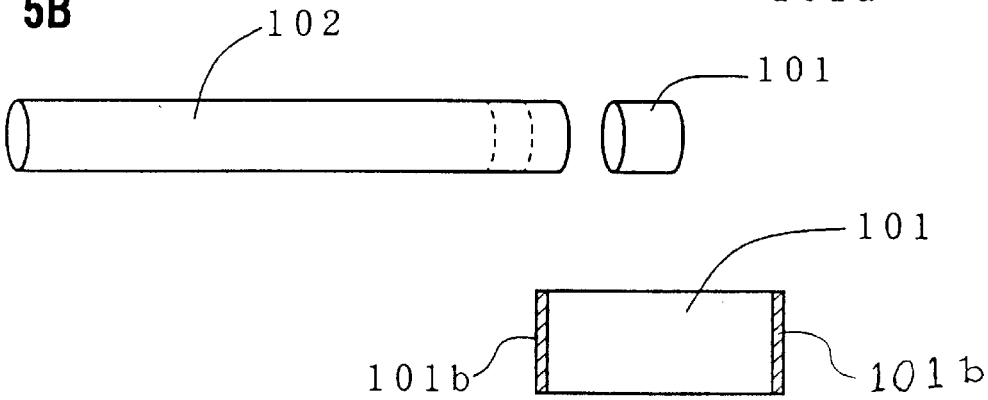

In a chip 101 shown in FIG. 5A, which was manufactured through punching of a rolled plate material 200, a surface layer portion 101*a* having a high hardness is formed in the vicinity of either end surface formed through rolling. If the chip 101 is used as is, without being subjected to annealing, in order to form the spark discharge portions 31 and 32 (FIG. 3), the surfaces 31*a* and 32*b* of the spark discharge portions 31 and 32 that face the gap have a high hardness, so that oxidation/volatilization of the Ir component easily occurs at these portions. In a chip 101 shown in FIG. 5B, which was manufactured through cutting a forged rod material 102 to a predetermined length, a surface portion 101*b* having a high hardness is formed in the vicinity of the outer circumferential surface. If the spark discharge portions 31 and 32 are formed by use of the chip 101, the spark discharge portions 31 and 32 have an increased hardness in the vicinity of the circumferential surfaces 31*a* and 32*a* of the spark discharge portions 31 and 32, so that oxidation/volatilization of the Ir component easily occurs at these portions. In either case, when chips having being subjected to the above-described annealing is used, the state in which the surface layer portion 101*a* or 101*b* has a high hardness can be eliminated, so that oxidation/volatilization of Ir is suppressed.

Figure 4:
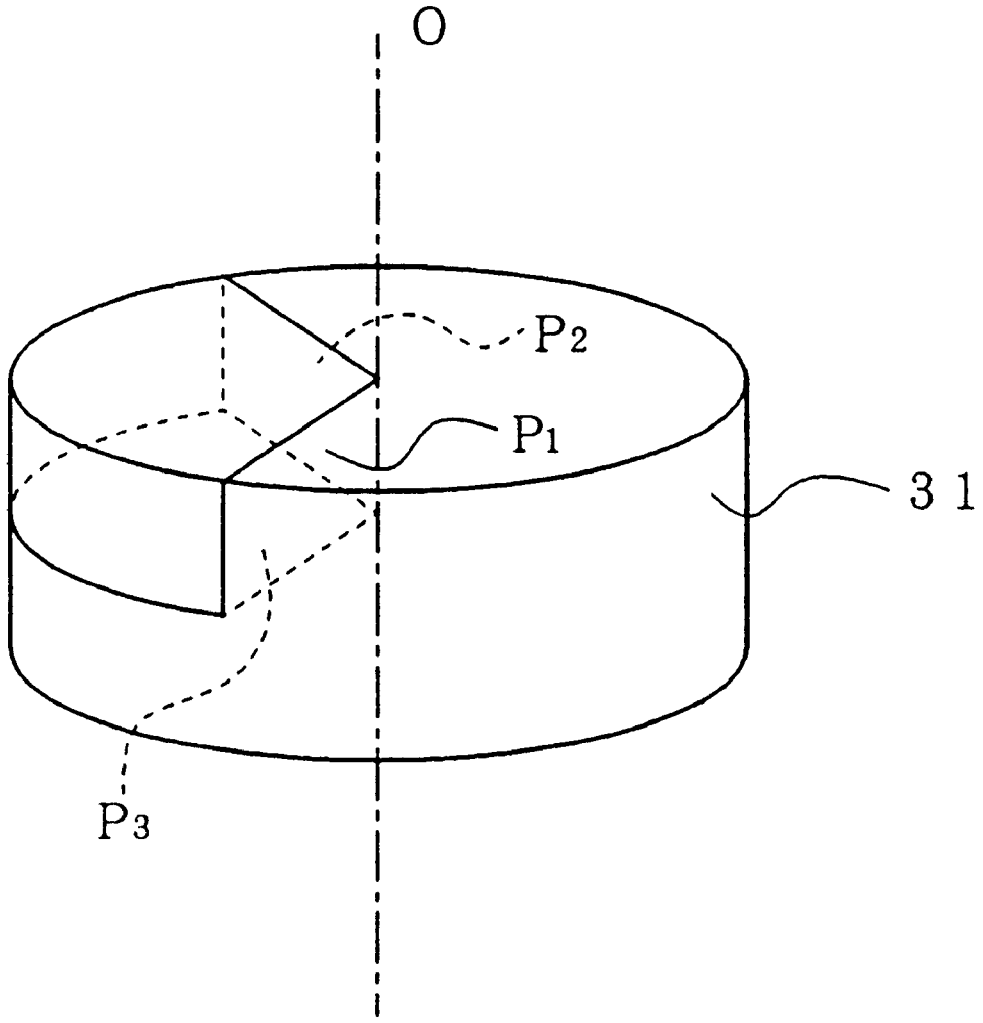
FIG. 4 is an explanatory view showing the positions of cross sections of the spark discharge portion.

The spark discharge portions 31 and 32 are preferably formed such that the average value of $d_{min}/d_{max}$ of grains becomes 0.7 or greater (preferably, 0.75 or greater) in all of first through third cross sections P1–P3 shown in FIG. 4 (in which only the spark discharge portion 31 is shown as a representative), wherein the first cross section P1 is coplanar with the center axis O of the center electrode 3, the second cross section P2 is coplanar with the center axis O of the center electrode and perpendicularly intersects the first cross section P1, and the third cross section P3 perpendicularly intersects the center axis O of the center electrode. When the spark discharge portion 31 or 32 is formed through use of the chip 101 of FIG. 5A that has not been annealed at all or has not been annealed to a sufficient level, grains stretched in the rolling direction become preponderant, so that the $d_{min}/d_{max}$ average value is likely to become less than 0.7. Meanwhile, when the spark discharge portion 31 or 32 is formed through use of the chip 101 of FIG. 5B that has not been annealed at all or has not been annealed to a sufficient level, grains stretched in the direction of drawing during forging become preponderant, so that the $d_{min}/d_{max}$ average value is likely to become less than 0.7 in the cross section P1 or P2. However, when these chips are used after having been sufficiently annealed, the spark discharge portion 31 or 32 has a $d_{min}/d_{max}$ average value of equal to or greater than 0.7 in any of the cross sections P1–P3.

Figure 5C:
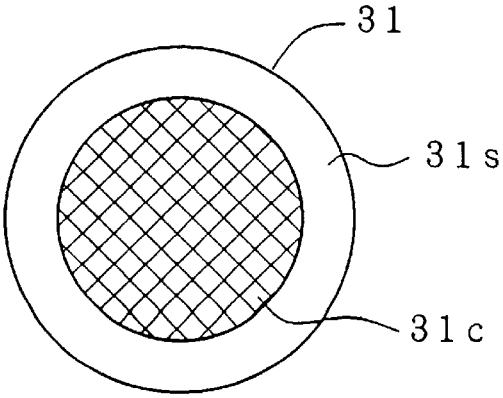

Through extension of annealing time, the chip 101 may be annealed such that the entire chip 101 has a Vickers hardness of Hv 400 or less (preferably Hv 370 or less). When the degree of work hardening of a chip for forming a spark discharge portion is considerably high, the center portion of the chip 101 may not be softened very much during the above-described annealing, e.g., if restoration and recrystallization of grains are restricted by surrounding crystal grains. Further, depending on the material of the chip 101, the Vickers hardness of the chip 101 sometimes cannot be decreased to Hv 400 or less. In order to overcome these problems, as shown in FIG. 5C, which shows only the spark discharge portion 31 as a representative, the surface area region 31S of the spark discharge portion 31 (or 32) formed through fixation of the chip 101 is softened to a greater degree compared to the remaining area (i.e., the central region) 31C such that the ratio of hS/hB becomes 0.9 or less (preferably, 0.85 or less). Through this softening, to some degree there can be enhanced the effect of suppressing oxidation/volatilization of the Ir component of the spark discharge portion to thereby increase the service life of the spark plug.

EXAMPLES

Example 1

Alloys containing Ir as a main component, Rh, and Pt in various compositions were manufactured by mixing Ir (purity: 99.9%), Rh, and Pt in predetermined amounts and melting the resultant mixtures. Each of the thus-obtained alloy materials was subjected to hot rolling (temperature: about 700° C.) to be formed into a plate having a thickness of 0.5 mm. The plate was then subjected to hot punching (temperature: about 700° C.) to form chips having a diameter of 0.7 mm and a thickness of 0.5 mm. Each of the thus-obtained chips was subjected to vacuum annealing at 1150° or 1200° C. for a holding time of 5, 10, 30, or 40 hours. For comparison purpose, an unannealed chip was manufactured.

Each chip was ground in order to form a cross section at a thicknesswise center portion and along a plane substantially perpendicular to the center axis. The thus-formed cross section was photographed through use of a light microscope in order to obtain the ratio ($d_{min}/d_{max}$) of the minimum diameter $d_{min}$ to the maximum diameter $d_{max}$ of each grain in accordance with a well-known image analyzing method. Subsequently, the average value of the ratios of grains was obtained.

Figure 7B:
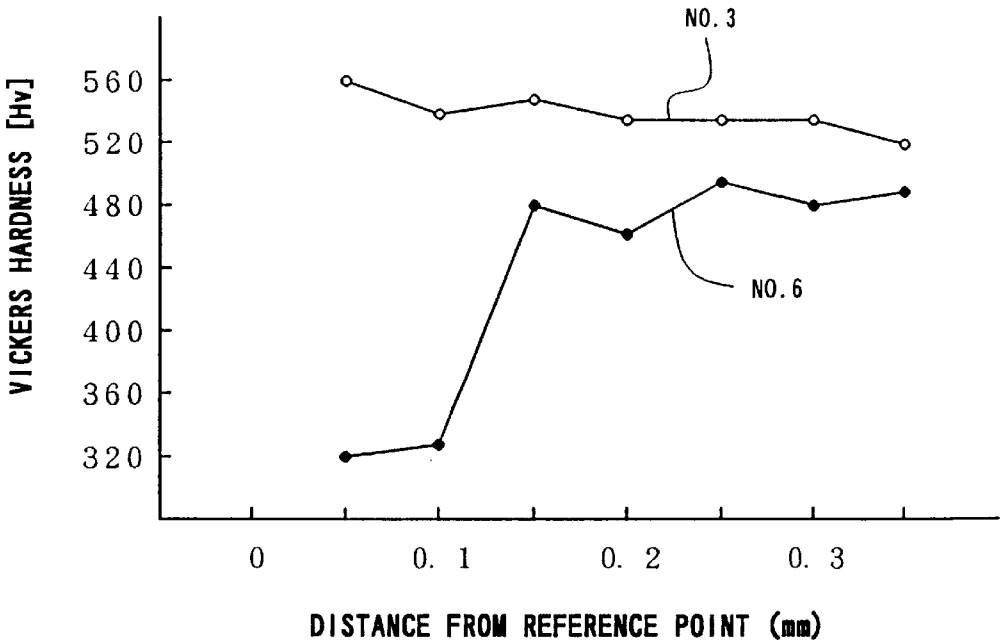
FIG. 7B is a graph showing the results of measurement performed for chips Nos. 3 and 6.
Figure 7A:
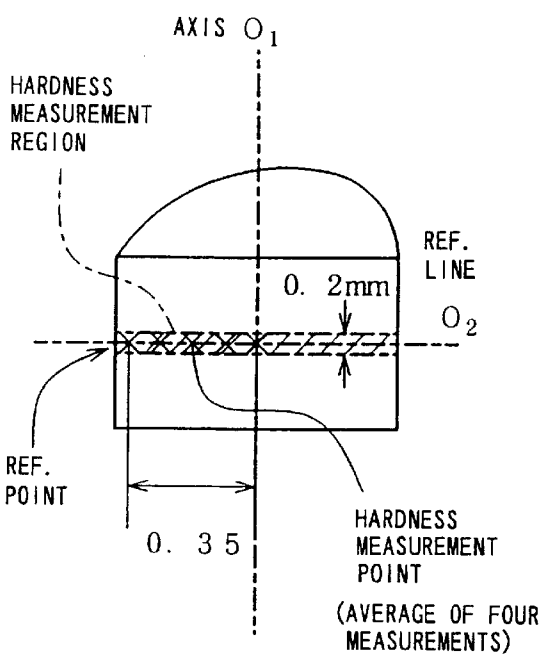
FIG. 7A is a schematic drawing of a sample used in measurement of cross-sectional hardness distribution in the embodiment.

Further, as shown in FIG. 7A, after each chip was cut along a plane containing the axis O1, there was defined an elongated hardness-measurement region which has a width of 0.2 mm and whose widthwise center coincides with a reference line O2 perpendicularly intersecting the axis O1. Distribution of Vickers hardness along the reference line O2 was measured at intervals of 0.05 mm from the surface located at one end of the reference line O2 (indicated as "reference point" in FIG. 7A) toward the center of the chip. The measurement was performed through use of a micro Vickers hardness tester, and at each point along the reference line O2, hardness was measured at four points in the widthwise direction of the hardness measurement region, and the hardness values were averaged in order to obtain the hardness at each point along the reference line O2. The hardness measured at a position that was 0.05 mm away from the reference point was taken as hardness $h_{0.05}$, and the hardness measured at a position that was 0.1 mm away from the reference point was taken as hardness $h_{0.1}$. The average of the two values ($(h_{0.05}+H_{0.1})/2$) was calculated as a surface layer hardness hS. Similarly, the hardness measured at a position that was 0.30 mm away from the reference point was taken as hardness $h_{0.30}$, the hardness measured at a position that was 0.35 mm away from the reference point was taken as hardness $h_{0.35}$, and the hardness measured at a position that was 0.40 mm away from the reference point was taken as hardness $h_{0.40}$. The average of the three values ($(h_{0.30}+h_{0.35}+h_{0.40})/3$) was calculated as a center portion hardness hB.

The chips were allowed to stand at 1100° C. for 30 hours in the air and were then measured for reduction in weight (hereinafter referred to as "oxidation loss," unit: wt. %). The results are shown in Table 1.

TABLE 1

| | Chip composition | Annealing Temp. (° C.) | Annealing Time (hr) | Hardness of Surface layer (hS) | Hardness of Center portion (hB) | hS/hB | dmin/dmax | Oxydation loss (%) |
|---|---|---|---|---|---|---|---|---|
| 1* | Ir-0.8 wt % Rh | No annealing | — | 497 | 486 | 1.02 | 0.08 | 28.9 |
| 2 | Ir-0.8 wt % Rh | 1150 | 30 | 285 | 420 | 0.68 | 0.87 | 14.3 |
| 3* | Ir-5 wt % Pt-5 wt % Rh | No annealing | — | 556 | 542 | 1.02 | 0.06 | 15.9 |
| 4 | Ir-5 wt % Pt-5 wt % Rh | 1150 | 5 | (380) | 516 | 0.74 | 0.70 | 12.1 |
| 5 | Ir-5 wt % Pt-5 wt % Rh | 1150 | 10 | (350) | 503 | 0.70 | 0.73 | 8.7 |
| 6 | Ir-5 wt % Pt-5 wt % Rh | 1150 | 30 | 328 | 494 | 0.66 | 0.74 | 4.3 |
| 7 | Ir-5 wt % Pt-5 wt % Rh | 1200 | 40 | 314 | 322 | 0.98 | 0.92 | 3.7 |
| 8* | Ir | No annealing | — | 568 | 572 | 0.99 | 0.04 | 81.8 |
| 9 | Ir | 1150 | 30 | 381 | 465 | 0.82 | 0.71 | 17.4 |
| 10 | Ir | 1200 | 40 | 386 | 374 | 1.03 | 0.77 | 17.8 |

*Outside of the scope of the invention.

As is apparent from Table 1, each of the chips whose surface layer hardness hS is not greater than 400 has a reduced amount of oxidation loss. This means that when a spark plug is manufactured through use of such chips, consumption of chips is prevented even in a high speed/high load operating state in which the temperature of the spark plug increases, so that the durability of the spark plug is enhanced. Further, it is also found that each of the chips has a $d_{min}/d_{max}$ average value equal to or greater than 0.7. By contrast, the chips (sample Nos. 1, 3, and 8) whose surface layer hardnesses hS are greater than Hv 400 have a large amount of oxidation loss (15% or more).

Figure 8A:
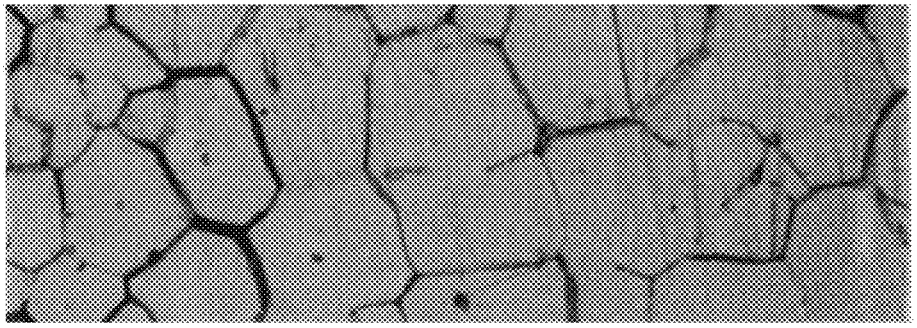
FIGS. 8A and 8B are light-microscope photographs of the surface layer portions of the cross sections of the chips Nos. 3 and 6.
Figure 8B:
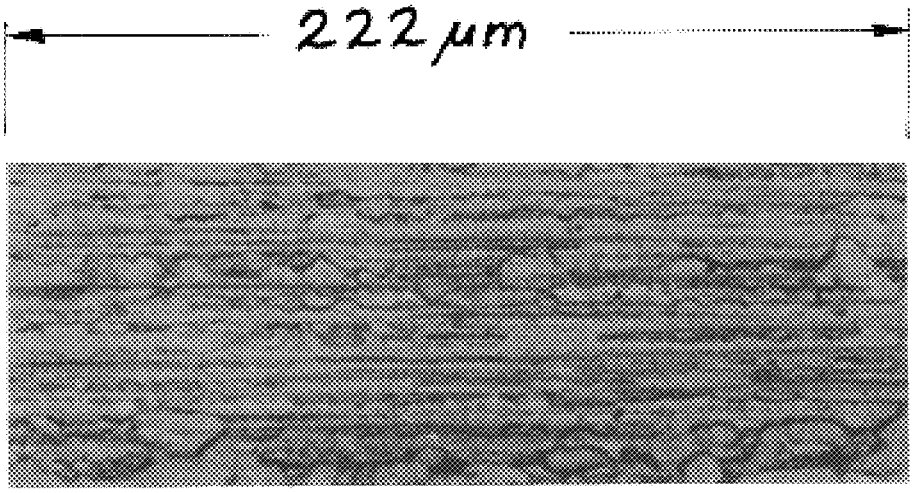

The opposingly disposed spark discharge portions 31 and 32 of the spark plug 100 shown in FIG. 2 were formed through use of chip No. 6 (Example, Surface layer hardness hs: Hv 328) and chip No. 3 (Comparative Example, Surface layer hardness hs: Hv 556). The spark discharge gap g was set to 1.1 mm. FIG. 7B shows the result of a measurement performed for each chip in order to measure the hardness distribution along the reference line. In the case of chip No. 6, the hardness is not greater than Hv 360 from the surface to a point 0.1 mm away from the surface and falls within the range of the present invention. By contrast, in the case of chip No. 3, the hardness is higher than Hv 500 regardless of the position. FIGS. 8A and 8B are photographs showing the structure of the chips taken through use of a light microscope. FIG. 8A shows the structure of chip No. 6, while FIG. 8B shows the structure of chip No. 3 (the scale bar indicates the length of 20 $\mu$m). In chip No. 3, which was not annealed, crystal grains that were stretched in one direction due to machining are preponderant. By contrast, in chip No. 6 that was annealed, recrystallization proceeded, and therefore each crystal grain exhibits a generally rounded isometric system structure.

Figure 9A:
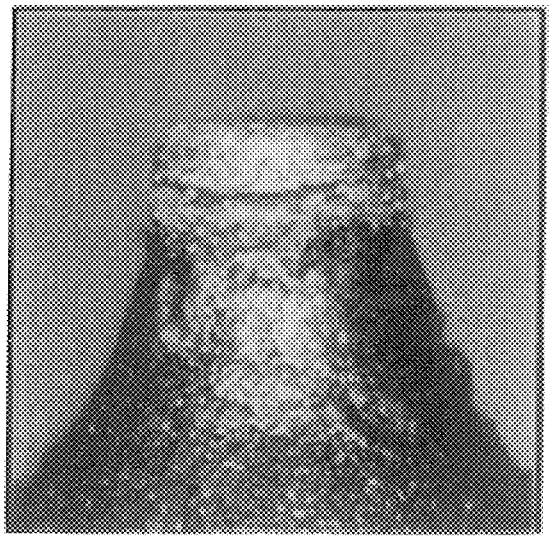
FIGS. 9A and 9B are photographs showing the post-test appearance of the spark plugs manufactured through use of the chips Nos. 3 and 6.
Figure 9B:
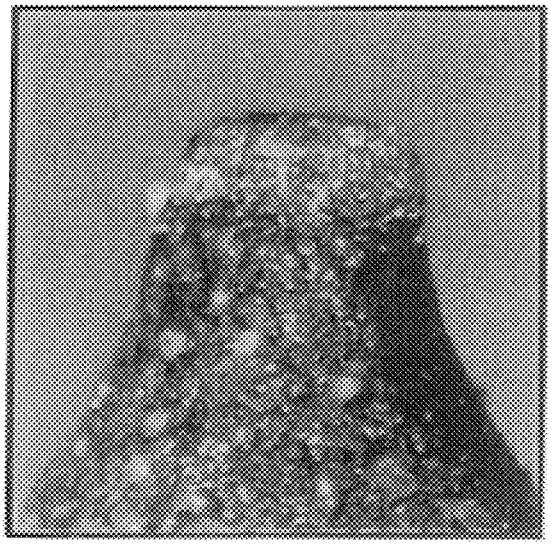

The performance of each of the thus-formed spark plugs (chips Nos. 3 and 6 only) was tested in a 6-cylinder gasoline engine (piston displacement: 2800 cc) under the following conditions: throttle completely opened, engine speed 5500 rpm, and 400-hour continuous operation (center electrode temperature: approx. 900° C.). After the test operation, the condition of the spark discharge portion of each spark plug was visually checked. FIGS. 9A and 9 B shows the appearances of the tested plugs. As shown in FIG. 9B, in the spark plug of Comparative Example whose spark discharge portion was formed of Chip No. 3 that was not annealed and therefore has a hardened surface layer, consumption of the spark discharge portion proceeded to a considerably large extent. By contrast, as shown in FIG. 9A, in the spark plug of Example whose spark discharge portion was formed of Chip No. 6 that was annealed to soften the surface layer, consumption of the spark discharge portion did not proceed very much, so that the spark plug has an improved consumption resistance.

Obviously, numerous modifications and variations of the present invention are possible in light of the above teachings. It is therefore to be understood that within the scope of the appended claims, the present invention may be practiced otherwise than as specifically described herein.

What is claimed is:

1. A spark plug comprising:

a center electrode;

an insulator provided outside said center electrode;

a metallic shell provided outside said insulator;

a ground electrode disposed to oppose said center electrode; and a spark discharge portion fixed on at least one of said center electrode and said ground electrode for defining a spark discharge gap, wherein said spark discharge portion is essentially formed of Ir, and a region where the Vickers hardness is not greater than Hv 400 extends from the surface of said spark discharge portion to a depth of 0.05 mm or more.

2. A spark plug according to claim 1, wherein the depth of the region where the Vickers hardness is not greater than Hv 400 is 0.1 mm or more.

3. A spark plug according to claim 1, wherein a region where the Vickers hardness is not greater than Hv 370 extends from the surface of said spark discharge portion to a depth of 0.05 mm or more.

4. A spark plug according to claim 3, wherein the depth of the region where the Vickers hardness is not greater than Hv 370 is 0.1 mm or more.

5. A spark plug according to claim 1, wherein said spark discharge portion is formed of a chip which is formed from a metallic material that contains Ir as a main component and is annealed at a temperature of 900° to 1700° C.

6. A spark plug according to claim 2, wherein said spark discharge portion is formed of a chip which is formed from a metallic material that contains Ir as a main component and is annealed at a temperature of 900° to 1700° C.

7. A spark plug according to claim 3, wherein said spark discharge portion is formed of a chip which is formed from a metallic material that contains Ir as a main component and is annealed at a temperature of 900° to 1700° C.

8. A spark plug according to claim 4, wherein said spark discharge portion is formed of a chip which is formed from a metallic material that contains Ir as a main component and is annealed at a temperature of 900° to 1700° C.

9. A spark plug according to claim 1, wherein the average value of $d_{min}/d_{max}$ ratios of grains on an arbitrary cross-section is equal to or greater than 0.7, where $d_{min}$ represents the minimum diameter of each grain on the cross-section and $d_{max}$ represents the maximum diameter of the grain.

10. A spark plug according to claim 9, wherein said spark discharge portion is formed of a chip which is formed from a metallic material that contains Ir as a main component and is annealed at a temperature of 900° to 1700° C.

11. A spark plug comprising:

a center electrode;

an insulator provided outside said center electrode;

a metallic shell provided outside said insulator;

a ground electrode disposed to oppose said center electrode; and a spark discharge portion fixed on at least one of said center electrode and said ground electrode for defining a spark discharge gap, wherein said spark discharge portion is essentially formed of Ir, and the average value of $d_{min}/d_{max}$ ratios of grains on an arbitrary cross-section is equal to or greater than 0.7, where $d_{min}$ represents the minimum diameter of each grain on the cross-section and $d_{max}$ represents the maximum diameter of the grain.

12. A spark plug according to claim 11, wherein said average value of $d_{min}/d_{max}$ ratios is equal to or greater than 0.75.

13. A spark plug according to claim 11, wherein said spark discharge portion is formed of a chip which is formed from a metallic material that contains Ir as a main component and is annealed at a temperature of 900° to 1700° C.

14. A spark plug according to claim 12, wherein said spark discharge portion is formed of a chip which is formed from a metallic material that contains Ir as a main component and is annealed at a temperature of 900° to 1700° C.

15. A spark plug comprising:

a center electrode;

an insulator provided outside said center electrode;

a metallic shell provided outside said insulator;

a ground electrode disposed to oppose said center electrode; and a spark discharge portion fixed on at least one of said center electrode and said ground electrode for defining a spark discharge gap, wherein said spark discharge portion is essentially formed of Ir, and the ratio of hS/hB is not greater than 0.9, where hS represents an average Vickers hardness measured in a surface layer region extending to a depth of 0.05 mm from the surface that faces the spark discharge gap, and hB represents an average Vickers hardness measured in the remaining region.

16. A spark plug according to claim 15, wherein said the ratio of hS/hB is equal to or less than 0.85.

17. A spark plug according to claim 15, wherein said spark discharge portion is formed of a chip which is formed from a metallic material that contains Ir as a main component and is annealed at a temperature of 900° to 1700° C.

18. A spark plug according to claim 16, wherein said spark discharge portion is formed of a chip which is formed from a metallic material that contains Ir as a main component and is annealed at a temperature of 900° to 1700° C.

19. A spark plug according to claim 15, wherein the average value of $d_{min}/d_{max}$ ratios of grains on an arbitrary cross-section is equal to or greater than 0.7, where $d_{min}$ represents the minimum diameter of each grain on the cross-section and $d_{max}$ represents the maximum diameter of the grain.

20. A spark plug according to claim 19, wherein said spark discharge portion is formed of a chip which is formed from a metallic material that contains Ir as a main component and is annealed at a temperature of 900° to 1700° C.

* * * * *